US007549937B2

(12) United States Patent
Irwin

(10) Patent No.: US 7,549,937 B2
(45) Date of Patent: Jun. 23, 2009

(54) GOLF BALL & TEE SETTER APPARATUS

(76) Inventor: Larry J. Irwin, 2361 Golden Shore Dr., Fenton, MI (US) 48430

( * ) Notice: Subject to any disclaimer, the term of this patent is extended or adjusted under 35 U.S.C. 154(b) by 141 days.

(21) Appl. No.: 11/705,083

(22) Filed: Feb. 12, 2007

(65) Prior Publication Data

US 2007/0293354 A1 Dec. 20, 2007

Related U.S. Application Data

(63) Continuation-in-part of application No. 11/454,639, filed on Jun. 19, 2006, now abandoned.

(51) Int. Cl.
*A63B 57/00* (2006.01)

(52) U.S. Cl. ..... 473/386

(58) Field of Classification Search ..... 473/386–403, 473/284, 286; 294/19.2
See application file for complete search history.

(56) References Cited

U.S. PATENT DOCUMENTS

| | | | | | |
|---|---|---|---|---|---|
| 1,890,388 | A | * | 12/1932 | Kramlik | 221/279 |
| 2,083,175 | A | * | 6/1937 | Werner | 473/284 |
| 2,606,764 | A | * | 8/1952 | Mason | 473/386 |
| 2,609,198 | A | | 9/1952 | Armstrong | |
| 2,793,862 | A | * | 5/1957 | O'Brien | 473/284 |
| 3,889,946 | A | * | 6/1975 | Setecka | 473/133 |
| 4,466,650 | A | * | 8/1984 | Roedel | 473/386 |
| 4,951,947 | A | | 8/1990 | Kopfle | |
| 4,969,646 | A | | 11/1990 | Tobias | |
| 5,037,150 | A | * | 8/1991 | Vecchi | 294/19.2 |
| 5,085,431 | A | * | 2/1992 | McGuire | 473/386 |
| 5,165,744 | A | * | 11/1992 | Vogrin | 473/386 |
| 5,306,000 | A | * | 4/1994 | Comella | 473/133 |
| 5,330,178 | A | | 7/1994 | Geishert, Sr. | |
| 5,494,279 | A | * | 2/1996 | Ahner | 473/386 |
| 5,540,432 | A | | 7/1996 | Keller | |
| 5,718,646 | A | * | 2/1998 | Brewer | 473/386 |
| 5,759,117 | A | | 6/1998 | Erickson, Jr. | |
| 6,843,737 | B1 | | 1/2005 | Smith et al. | |
| 7,422,530 | B1 | * | 9/2008 | Olaveson | 473/386 |

* cited by examiner

*Primary Examiner*—Steven Wong
(74) *Attorney, Agent, or Firm*—William M. Hobby, III

(57) ABSTRACT

A golf ball and tee setting apparatus allows a golf tee to be set in the ground and a golf ball placed thereon without the golfer having to bend over. An elongated shaft has two end portions and a ball supporting member on one end portion of the shaft and a bore on the other end of the elongated shaft. A golf tee is releasably held in the shaft bore for insertion into the earth. The shaft can then e rotated to a golf ball supporting end and a golf ball placed on the tee.

13 Claims, 4 Drawing Sheets

GOLF BALL & TEE SETTER APPARATUS

BACKGROUND OF THE INVENTION

This patent application is a continuation-in-part of my U.S. patent application Ser. No. 11/454,639, filed Jun. 19, 2006 for a Golf ball & Tee Setter Apparatus now abandoned.

The present invention relates generally to a golf ball and tee setting apparatus and particularly to such an apparatus which allows the setting of a golf tee into the ground and setting the golf ball on top thereof without the user having to bend over at the waist.

Presently, it is necessary for a golfer to bend at the waist or knees in order to insert a golf tee into the ground and place a golf ball on the tee. Many people enjoy the sport of golf despite having various physical limitations so that the process of teeing up the ball can cause severe physical pain to some golfers, such as elderly golfers or golfers with back or knee problems. For some handicapped golfers, the task of teeing a golf ball is not only difficult but may be impossible.

The present invention provides an apparatus in which an elderly or handicapped golfer with back problems can place a tee into the ground and set a golf ball on top of the tee from a standing position. A number of different types of golf ball and tee placing devices have been provided in the past. The prior art Smith et al. U.S. Pat. No. 6,843,737 shows a golf ball and tee setting device and method which facilitates the setting of a tee into the ground with a ball on top of it without causing the user to bend over at the waist. The Armstrong U.S. Pat. No. 2,609,198 and the Kopfle U.S. Pat. No. 4,951,947 disclose golf ball and tee combinations in which the ball holding mechanism is biased in an upward and open position. They require the user to forcibly hold a trigger or knob to retain the ball and tee combination during a golf ball and tee setting. The Setecka, U.S. Pat. No. 3,889,946, shows a portable adjustable tee and ball positioning device for pressing golf ball tees into the ground at desired positions and to the desired depth and height without the user bending over to manually mount the tee into the ground. The Erickson, Jr. U.S. Pat. No. 5,759,117 teaches another golf ball and tee placing device in which the golfer may handle a golf ball without having to bend over. The Keller U.S. Pat. No. 5,540,432 is a golf tee and ball setter for non-stooping placement of golf balls and golf tees on site. The Ahner U.S. Pat. No. 5,494,279 is another golf ball tee setting device for setting a golf tee into the ground. The Tobias U.S. Pat. No. 4,969,646 is yet another golf ball tee and placement device as is the Geishert, Sr. U.S. Pat. No. 5,330,178.

In my prior U.S. patent application Ser. No. 11/454,639 for a Golf ball & Tee Setter Apparatus, a golf ball and tee setting apparatus has an integrated and coordinated golf tee having an elongated bore therethrough which is held onto a prong and allows the golf tee to be set into the ground at a predetermined depth and then allows the other end of the apparatus to place a golf ball on the tee without the golfer to have to bend over.

BRIEF DESCRIPTION OF THE DRAWING

Other objects, features, and advantages of the present invention will be apparent from the written description and the drawings in which.

SUMMARY OF THE INVENTION

A golf ball and tee setting apparatus allows a tee to be set in the ground and a golf ball placed thereon without the golfer having to bend over. The golf ball and tee setting apparatus has an elongated shaft having two end portions and a ball supporting member on one end portion of a shaft and a bore in the other end of the elongated shaft. The golf tee has two end portions and a golf ball support surface on one end portion and a generally elongated earth inserting prong on the other end portion. The golf tee has a collar between the end portions thereof and has a generally cylindrical tee holding member on one side of the collar shaped to fit into the elongated shaft elongated bore for releasably holding the golf tee in the elongated bore. The tee can be placed in the elongated bore in the shaft and held therein by the tee-holding member and inserted into the ground by a standing golfer. The golfer can then lift the shaft from the tee and use the ball supporting member on the one end of the shaft to place the ball on the tee. The elongated shaft has a tee lifting tool on the one end which can be used for removing the tee from the earth once the golf ball has been hit. The tee holding member can be of a resilient polymer or the like for press fitting into the bore in the shaft.

DETAILED DESCRIPTION OF THE PREFERRED EMBODIMENT

Figure 1:
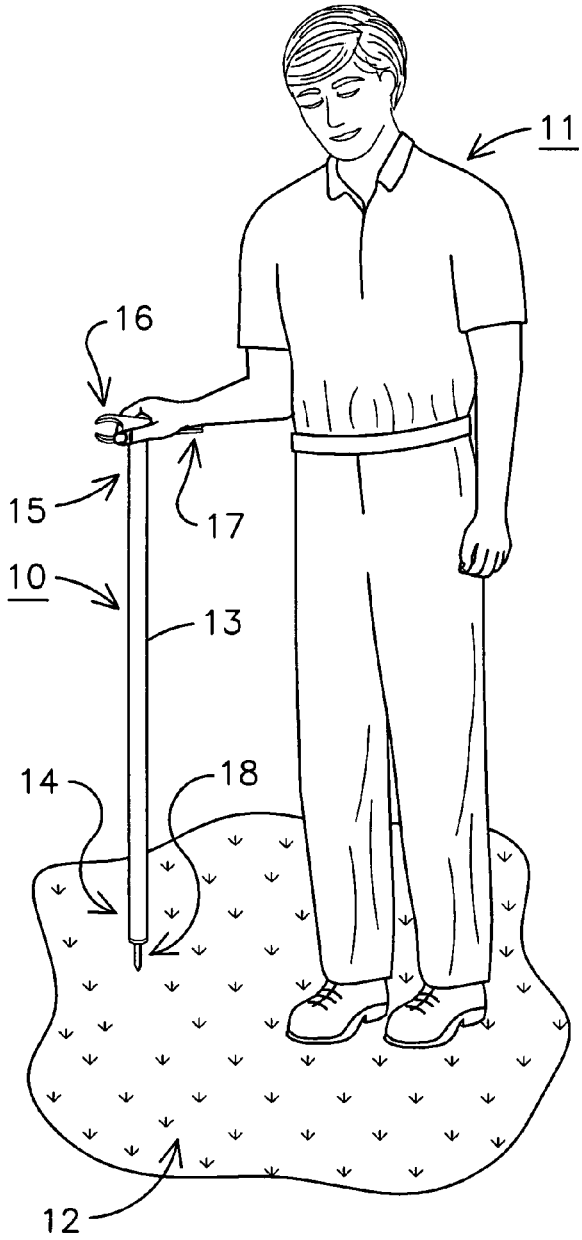
FIG. 1 is a perspective view of a golfer holding a golf ball and tee setter in accordance with the present invention and placing the tee into the ground.

Referring to the drawings, FIGS. 1 through 6, a golf ball and golf tee setter 10 is shown being held by a golfer 11 standing on a golf course 12. The golf tee and golf ball setter 10 has an elongated shaft 13 having a tee setting end 14 and a ball setting and golf tee removing end 15 having a ball setter 16 and a tee remover 17. A golfer 11 is seen in FIG. 1 holding one end of the shaft 13 while inserting a golf tee 18 into the ground of the golf course 12.

Figure 2:
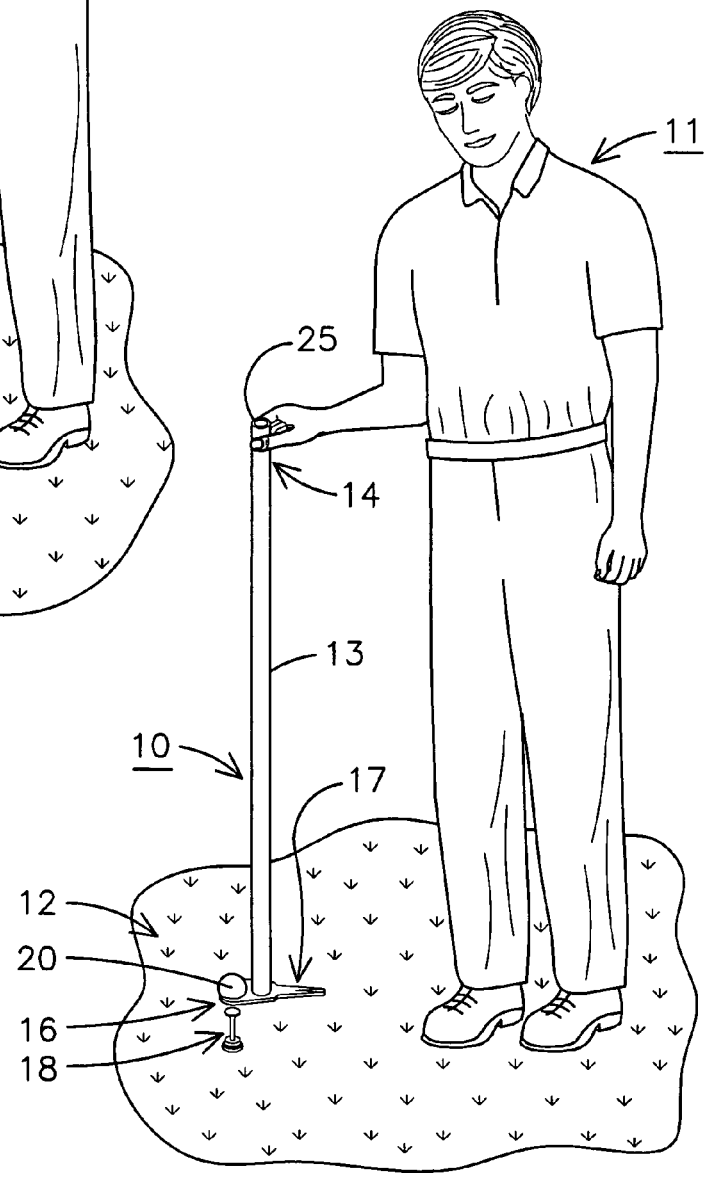
FIG. 2 is a perspective view of the golfer of FIG. 1 using the golf ball and tee setter to place the ball on the tee.

The golfer 11 in FIG. 2 is holding the golf ball and golf tee setter 10 end portion 14 while placing a golf ball 20 into the tee 18 after the tee has been set in the ground of the golf course 12.

Figure 3:
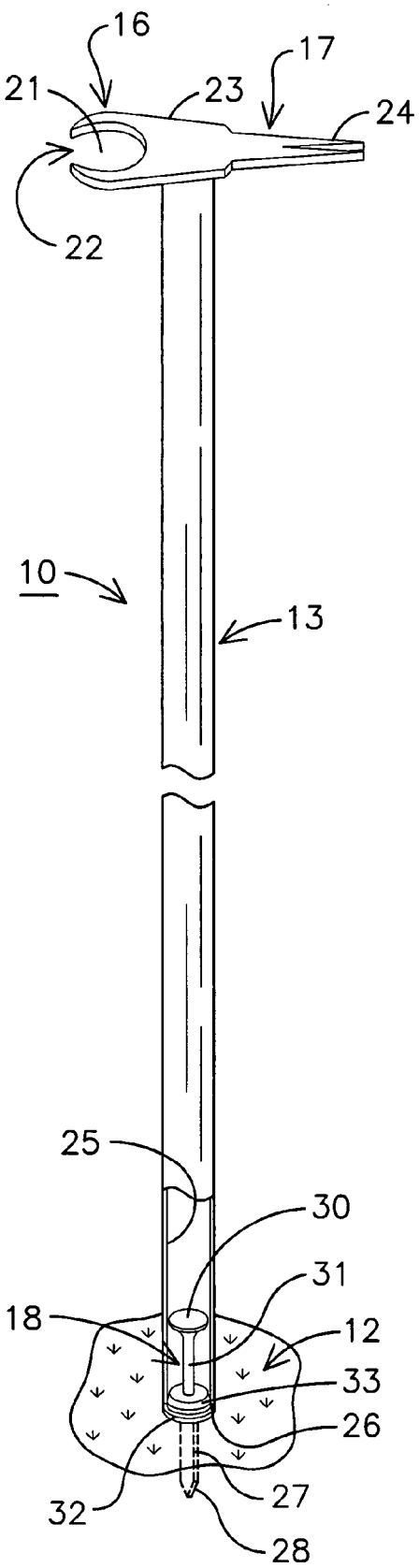
FIG. 3 is a cutaway perspective view of the golf ball and tee setter of FIGS. 1 and 2.

The golf ball and golf tee setter 10, as seen in FIG. 3, has the golf ball setter 16 extending perpendicular from the shaft 13 and has a generally round open space 21 having an open end 22 in a flat metal or plastic surface 23. The flat surface 23 also has the tee removing or gripping member 17 extending perpendicular from the shaft 13 and has a yoke 24 for sliding around the shaft of a golf tee for removing the tee from the earth. The tee setting end 14 of the shaft 13 may be seen having an elongated bore 25 extending thereinto from the end 26 and is shown holding the golf tee 18 by a frictional engagement while it is being inserted in the ground 12.

Figure 4:
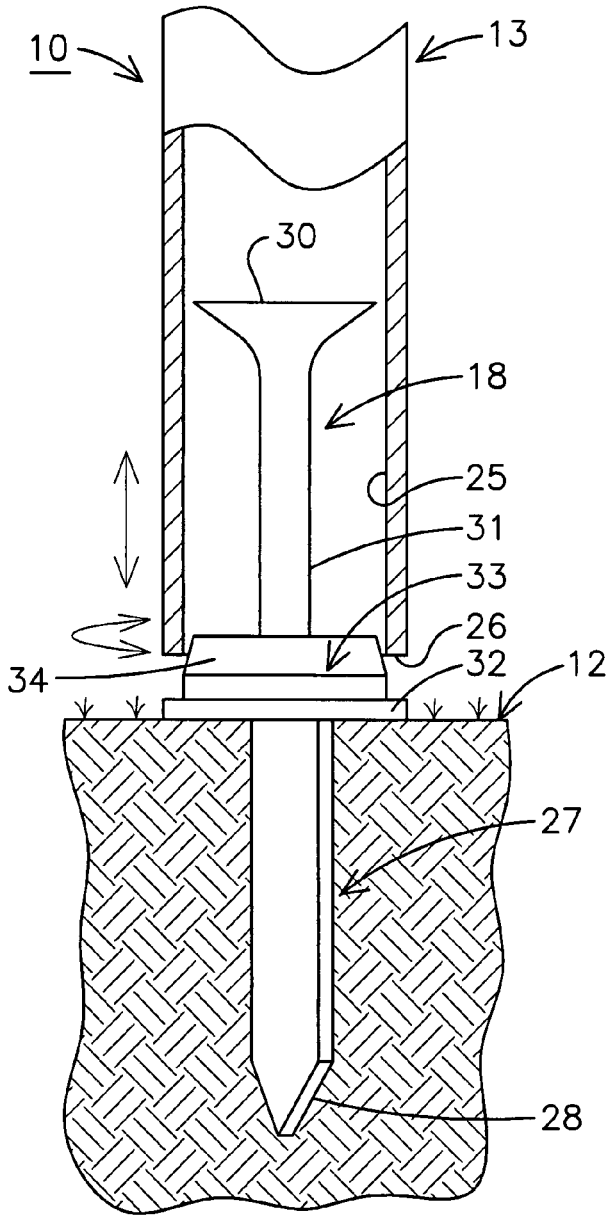
FIG. 4 is a partial sectional view of the golf tee being inserted into the ground with the golf ball and tee setter.

The tee 18, as more clearly seen in FIG. 4, has a ground insertion prong 27 which has a pointed end 28 on one end portion thereof and has a golf ball supporting surface 30 on the other end thereof with a shaft 31 therebetween having a generally disc shaped collar 32 positioned between the ends of the tee 18. A generally cylindrical tee-holding member 33 is mounted on one side of the collar 32 and has an annular angled edge surface 34. The tee holding member 33 may be made of a resilient polymer material, such as a rubber, or any resilient material, which allows a tee 18 to have the tee holding member 33 press fitted within the bore 25 of the shaft 13 where it can be removably held in the shaft 13 until the prong 27 is inserted into the earth and the shaft 13 lifted from the tee. The shaft can be turned slightly to break the friction hold of the tee 18 in the shaft 13. The shaft can then be rotated for placing the golf ball on the golf supporting surface 30. The annular angled surface 34 advantageously allows the golf tee to be slid into the bore 25 where the tee holding member 33 removably holds the golf tee until it is placed in the earth.

Figure 5:
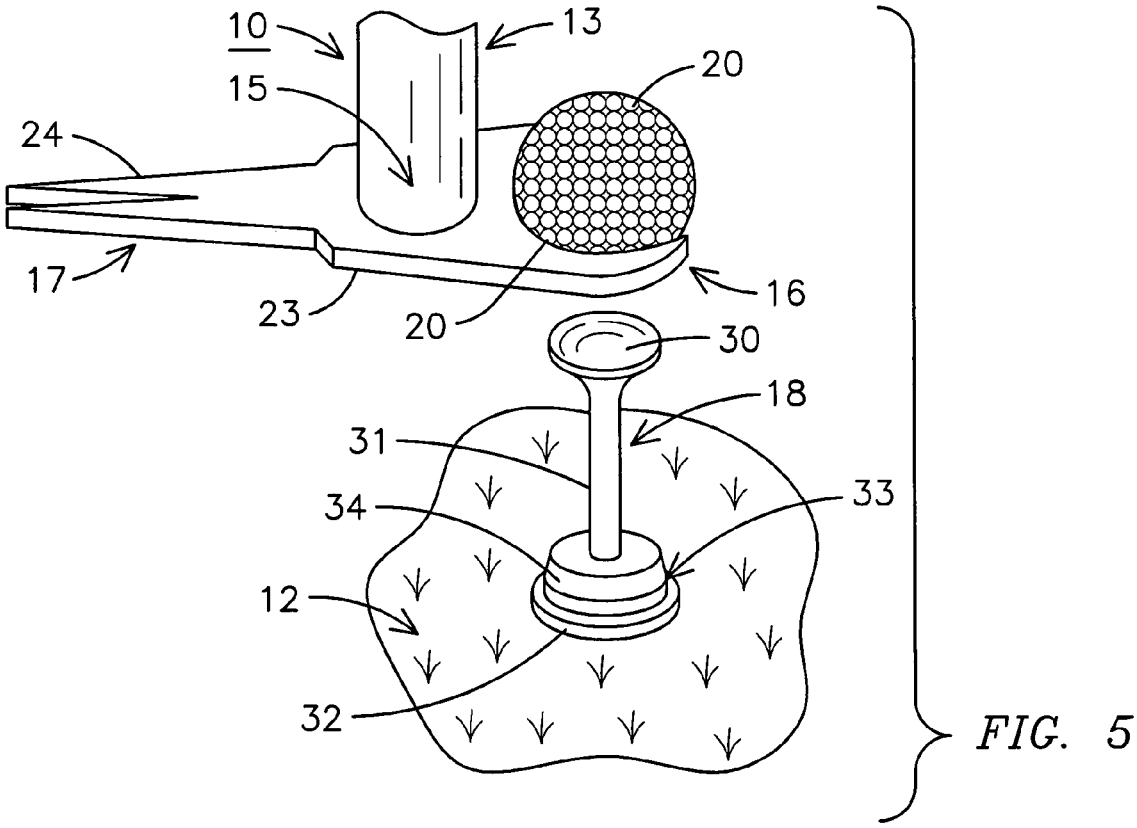
FIG. 5 is a partial perspective view of a golf ball being placed on the golf tee.

Referring to FIG. 5, the golf ball 20 is being placed onto the golf tee 18 golf ball supporting surface 30 after the tee 18 has been inserted into the golf course 12 until the collar 32 abuts the surface 12. The golf ball setter 16 portion located on the end of the shaft 13 is seen holding the golf ball 20 where it can be set on the golf ball holding portion 30 of the tee 18. The golf ball setter 16 is then removed leaving the ball sitting on the tee.

Figure 6:
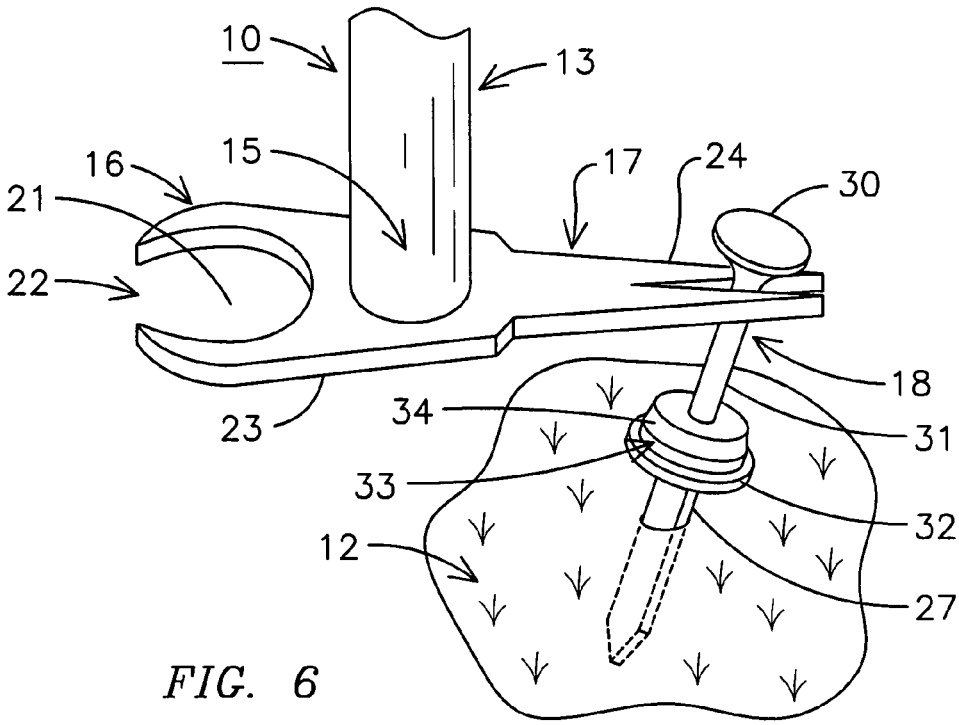
FIG. 6 is a partial perspective view of a golf tee being removed from the ground.

In FIG. 6, a golf tee gripper or remover 17 is shown having the yoke 24 around the shaft portion 31 of the tee 18 underneath the golf supporting surface 30 and removing the tee from the earth 12.

Figure 7:
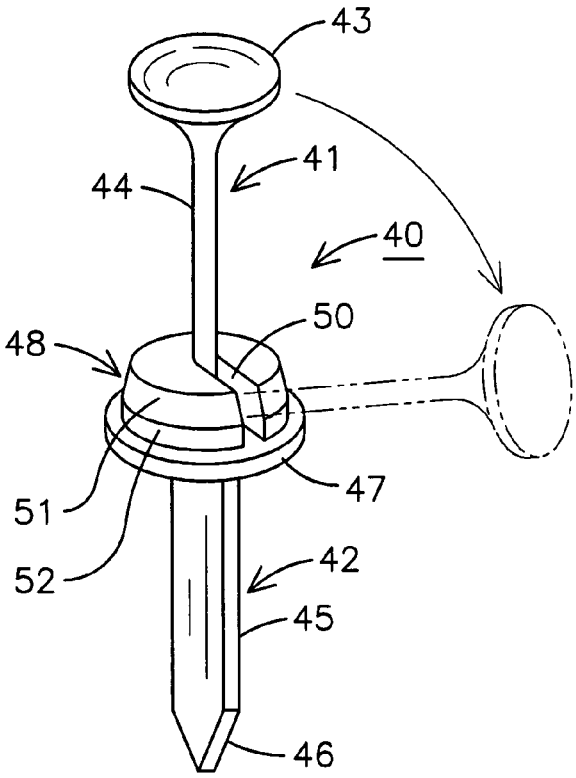
FIG. 7 is a perspective view of an alternate embodiment of a golf tee of the present invention.
Figure 8:
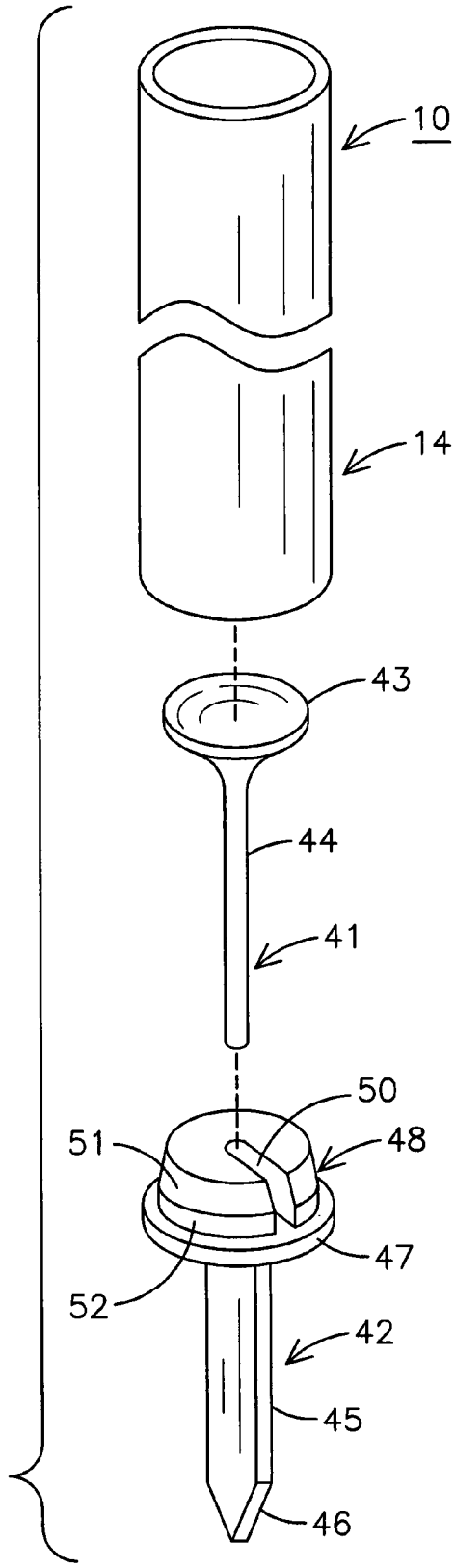
FIG. 8 is an exploded perspective view of the golf tee of FIG. 7.

Turning to FIGS. 7 and 8, an alternate embodiment of a two part golf tee 40 is illustrated having two separate portions. A generally standard golf tee 41 and a separate tee holder and ground inserting prong 42. The separate tee portion 41 has a golf ball support surface 43 and a shaft 44 while the ground inserting portion 42 has an elongated prong 45 having a pointed end 46 and a collar 47 mounted on the other end thereof. The collar 47 is used to limit the insertion of the prong 45 into the earth and also has a resilient tee holding member 48 mounted on top of the collar 47. A tee holding member 48 may be of a resilient material, such as rubber or any resilient polymer, and has a slot 50 on one side thereof which allows the shaft 44 of the tee portion 41 to be inserted therein, as illustrated in FIG. 7. The resilient tee holding member 48 has an annular angled surface 51 on its edge abutting a generally cylindrical portion 52.

The tee support member 48 is inserted in the end 14 of the shaft 10 into the bore 25 for placing the tee 40 into the earth. Thus, the golf tee portion 41 is inserted into the tee holding member 48, slot 50 where it is removably held in a vertical position while the combined golf tee 40 is inserted into the end of the shaft 14 and held by the golf tee holding member 48 while the golf tee is inserted into the ground. The object of the two part tee 40 is to have a light top 41. This is for the golfer who is looking for low resistance when hitting the ball and to help pick a height for the tee. The golfer can do this by cutting shaft 41 to a desired height.

It should be clear at this time that a golf ball and tee setter has been provided which works in conjunction with a matching golf tee. This allows for a golf ball and tee setter of reduced complexity and reduced cost and allows a handicapped or older golfer to play the sport of golf without having to bend over.

However, the present invention is not to be considered limited to the forms shown which are to be considered illustrative rather than restrictive.

I claim:

1. A golf ball and tee setting apparatus comprising:

an elongated shaft having two end portions;

a ball supporting member on one end portion of said shaft;

an elongated bore in the other end of said elongated shaft;

a golf tee having two end portions and having a golf ball support surface on one end portion and a generally pointed end on the other end portion and having a collar between the end portions thereof and having a generally cylindrical tee holding member on one side of said collar shaped to fit into said elongated shaft elongated bore for releasably holding said golf tee in said elongated bore;

whereby said tee can be placed in said elongated bore in said elongated shaft and held by friction therein by said tee holding member and inserted into the ground by a standing golfer and the shaft lifted from said tee.

2. The golf ball and tee setting apparatus in accordance with claim 1 in which said tee holding member has annular angled edge.

3. The golf ball and tee setting apparatus in accordance with claim 1 in which said golf tee said collar is positioned to limit the insertion of the tee into the shaft elongated bore.

4. The golf ball and tee setting apparatus in accordance with claim 3 in which said golf tee said golf tee collar is positioned to limit the insertion of said tee into the earth.

5. The golf ball and tee setting apparatus in accordance with claim 4 in which said golf tee holding member is made of a resilient material for press fitting into said elongated bore.

6. The golf ball and tee setting apparatus in accordance with claim 5 in which said ball supporting portion extends perpendicular to said elongated shaft and has an opening therein for supporting a golf ball for placement onto said tee.

7. The golf ball and tee setting apparatus in accordance with claim 6 having a golf tee gripping member on said elongated shaft one end thereof whereby a said tee may be gripped and removed from the ground by a standing golfer.

8. The golf ball and tee setting apparatus in accordance with claim 7 in which said golf tee gripping member is a yoke for slipping over said golf tee below the ball support surface.

9. The golf ball and tee setting apparatus in accordance with claim 6 in which said tee holding member is made of a polymer.

10. The golf ball and tee setting apparatus in accordance with claim 1 in which said golf tee golf ball support surface end portion is removably attached to said other end portion.

11. The golf ball and tee setting apparatus in accordance with claim 10 in which said golf tee golf ball support surface end portion includes a shaft that is held in a slot in said tee holding member.

12. The golf ball tee setting apparatus in accordance with claim 1 in which said golf tee two end portions are removably attached to each other.

13. The golf ball tee setting apparatus in accordance with claim 12 in which said ball support surface has a shaft extending therefrom removably attached to said tee holding member.

* * * * *